US008786587B2

(12) United States Patent
Kang et al.

(10) Patent No.: US 8,786,587 B2
(45) Date of Patent: Jul. 22, 2014

(54) PIXEL AND ORGANIC LIGHT EMITTING DISPLAY USING THE SAME

(75) Inventors: Chul-Kyu Kang, Yongin (KR); Yu-Lian Choi, Yongin (KR); Keum-Nam Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 795 days.

(21) Appl. No.: 12/698,399

(22) Filed: Feb. 2, 2010

(65) Prior Publication Data

US 2010/0309187 A1 Dec. 9, 2010

(30) Foreign Application Priority Data

Jun. 5, 2009 (KR) ..... 10-2009-0049848

(51) Int. Cl.
*G06F 3/038* (2013.01)

(52) U.S. Cl.
USPC ..... 345/211

(58) Field of Classification Search
USPC ..... 345/76–78, 211
See application file for complete search history.

(56) References Cited

U.S. PATENT DOCUMENTS

| | | | | |
|---|---|---|---|---|
| 2004/0257353 | A1 | 12/2004 | Imamura et al. | |
| 2007/0132694 | A1* | 6/2007 | Uchino et al. | 345/92 |
| 2008/0225022 | A1* | 9/2008 | Kim | 345/204 |
| 2008/0252568 | A1* | 10/2008 | Kwon | 345/76 |
| 2009/0231308 | A1* | 9/2009 | Numao | 345/204 |

FOREIGN PATENT DOCUMENTS

| | | | |
|---|---|---|---|
| EP | 2128848 | A1 | 12/2009 |
| JP | 2006-039505 | | 2/2006 |
| JP | 2006-195459 | | 7/2006 |
| KR | 10-2005-0109167 | | 11/2005 |
| KR | 10-2006-0024869 | | 3/2006 |
| KR | 1020070116389 | A | 12/2007 |
| KR | 10-2008-0080754 | | 9/2008 |
| KR | 10-2008-0113998 | | 12/2008 |
| WO | WO 2006/103797 | A1 | 10/2006 |

OTHER PUBLICATIONS

Extended European Search Report dated Jun. 4, 2010 of the corresponding European Patent Application No. 10158802.8, noting listed references in this IDS.
JP Office action dated Apr. 3, 2012 relating to JP Application No. 2009-225324, 2 pages.

* cited by examiner

*Primary Examiner* — William Boddie
*Assistant Examiner* — Towfiq Elahi
(74) *Attorney, Agent, or Firm* — Christie, Parker & Hale, LLP

(57) ABSTRACT

A pixel includes an organic light emitting diode (OLED) having a cathode electrode coupled to a second power source, a first transistor for controlling an amount of current that flows from a first power source to the second power source via the OLED corresponding to a data signal, a second transistor coupled between a data line and a gate electrode of the first transistor, a third transistor coupled between the gate electrode of the first transistor and a reference power source, a fourth transistor coupled between the third transistor and the reference power source, a fifth transistor coupled between an anode electrode of the OLED and an initial power source, a first capacitor coupled between the anode electrode of the OLED and a node between the third transistor and the fourth transistor, and a second capacitor coupled between the node and the gate electrode of the first transistor.

16 Claims, 3 Drawing Sheets

PIXEL AND ORGANIC LIGHT EMITTING DISPLAY USING THE SAME

CROSS-REFERENCE TO RELATED APPLICATION

This application claims priority to and the benefit of Korean Patent Application No. 10-2009-0049848, filed on Jun. 5, 2009, in the Korean Intellectual Property Office, the entire content of which is incorporated herein by reference.

BACKGROUND

1. Field

The following description relates to a pixel and an organic light emitting display using the same.

2. Description of the Related Art

Recently, various flat panel displays (FPDs) having reduced weight and volume as compared to cathode ray tubes (CRTs) have been developed. The FPDs include liquid crystal displays (LCDs), field emission displays (FEDs), plasma display panels (PDPs), and organic light emitting displays.

Among the FPDs, the organic light emitting displays display images using organic light emitting diodes (OLEDs) that generate light through the re-combination of electrons and holes. The organic light emitting display has fast response times and is driven with low power consumption.

FIG. 1 is a circuit diagram illustrating a pixel of a conventional organic light emitting display. In FIG. 1, transistors included in the pixel are NMOS transistors.

Referring to FIG. 1, a pixel 4 of the conventional organic light emitting display includes an organic light emitting diode (OLED), and a pixel circuit 2 coupled to a data line Dm and a scan line Sn to control the OLED.

The anode electrode of the OLED is coupled to the pixel circuit 2 and the cathode electrode of the OLED is coupled to a second power source ELVSS. The OLED generates light with a predetermined brightness corresponding to current supplied from the pixel circuit 2.

The pixel circuit 2 controls an amount of current supplied to the OLED corresponding to a data signal supplied to the data line Dm when a scan signal is supplied to the scan line Sn. Therefore, the pixel circuit 2 includes a second transistor M2 (that is, a driving transistor) coupled between a first power source ELVDD and the OLED, a first transistor M1 coupled between the second transistor M2 and the data line Dm, and having a gate electrode coupled to the scan line Sn, and a storage capacitor Cst coupled between a gate electrode and a second electrode of the second transistor M2.

The gate electrode of the first transistor M1 is coupled to the scan line Sn, and the first electrode thereof is coupled to the data line Dm. The second electrode of the first transistor M1 is coupled to one terminal of the storage capacitor Cst. Here, the first electrode of the first transistor M1 is one of a source electrode or a drain electrode, and the second electrode thereof is the other one of the source electrode or the drain electrode. For example, when the first electrode is a source electrode, the second electrode is a drain electrode. The first transistor M1 is turned on when a scan signal is supplied from the scan line Sn to supply a data signal supplied from the data line Dm to the storage capacitor Cst. At this time, the storage capacitor Cst charges a voltage corresponding to the data signal.

The gate electrode of the second transistor M2 is coupled to one terminal of the storage capacitor Cst, and the first electrode thereof is coupled to the first power source ELVDD. The second electrode of the second transistor M2 is coupled to the other terminal of the storage capacitor Cst and the anode electrode of the OLED. The second transistor M2 controls the amount of current supplied from the first power source ELVDD to the second power source ELVSS via the OLED corresponding to the voltage value stored in the storage capacitor Cst.

One terminal of the storage capacitor Cst is coupled to the gate electrode of the second transistor M2 and the other terminal of the storage capacitor Cst is coupled to the anode electrode of the OLED. The storage capacitor Cst charges the voltage corresponding to the data signal.

The conventional pixel 4 supplies a current corresponding to the voltage charged in the storage capacitor Cst to the OLED to display an image with a predetermined brightness. However, a conventional organic light emitting display using the above-described pixel cannot display an image having uniform brightness throughout the display due to deviations in the threshold voltages of the second transistors M2 in different pixels.

Specifically, when the threshold voltages of the second transistors M2 vary between different pixels 4, the pixels 4 generate light with different brightnesses corresponding to the same data signal, and an image with uniform brightness cannot be displayed or is very difficult to display.

SUMMARY OF THE INVENTION

Accordingly, exemplary embodiments of the present invention provide pixels for displaying an image with uniform brightness, independent of the threshold voltages of driving transistors in the pixels, and an organic light emitting display using the same.

According to an exemplary embodiment of the present invention, there is provided a pixel, including an organic light emitting diode (OLED) having a cathode electrode coupled to a second power source, a first transistor for controlling an amount of current that flows from a first power source to the second power source via the OLED corresponding to a data signal, a second transistor coupled between a data line and a gate electrode of the first transistor and turned on when a scan signal is supplied to a scan line, a third transistor coupled between the gate electrode of the first transistor and a reference power source and turned off when an emission control signal is supplied to an emission control line, a fourth transistor coupled between the third transistor and the reference power source and turned on when a control signal is supplied to a control line, a fifth transistor coupled between an anode electrode of the OLED and an initial power source and turned on when the scan signal is supplied to the scan line, a first capacitor coupled between the anode electrode of the OLED and a node between the third transistor and the fourth transistor, and a second capacitor coupled between the node and the gate electrode of the first transistor.

The second transistor and the fifth transistor may be on for a portion of a period in which the fourth transistor is on. The second transistor and the fifth transistor may be configured to be turned on when the fourth transistor is turned on. The third transistor may be off when the fourth transistor is on. The reference power source may have a voltage equal to or higher than a voltage of the data signal. The initial power source may have a voltage lower than the voltage of the data signal. The voltage of the initial power source may be lower than a voltage obtained by subtracting a threshold voltage of the first transistor from the voltage of the data signal. The first power source may have a voltage higher than the voltage of the reference power source.

According to another exemplary embodiment of the present invention, there is provided an organic light emitting display, including a scan driver for sequentially supplying a scan signal to scan lines, sequentially supplying an emission control signal to emission control lines, and sequentially supplying a control signal to control lines, a data driver for supplying a data signal to data lines corresponding to the scan signal, and pixels at crossing regions of the scan lines and the data lines. A pixel positioned on an ith (i is a natural number) horizontal line from among the pixels includes an organic light emitting diode (OLED) having a cathode electrode coupled to a second power source, a first transistor for controlling an amount of current that flows from a first power source to the second power source via the OLED corresponding to the data signal, a second transistor coupled between the data line and a gate electrode of the first transistor and turned on when the scan signal is supplied to an ith scan line of the scan lines, a third transistor coupled between the gate electrode of the first transistor and a reference power source and turned off when the emission control signal is supplied to an ith emission control line of the emission control lines, a fourth transistor coupled between the third transistor and the reference power source and turned on when the control signal is supplied to an ith control line of the control lines, a fifth transistor coupled between an anode electrode of the OLED and an initial power source and turned on when the scan signal is supplied to the ith scan line, a first capacitor coupled between the anode electrode of the OLED and a node between the third transistor and the fourth transistor, and a second capacitor coupled between the node and the gate electrode of the first transistor.

The scan driver may be configured to supply the scan signal to the ith scan line when the control signal is supplied to the ith control line. The control signal may have a longer duration than the scan signal. The scan driver may be configured to supply the emission control signal to the ith emission control line when the control signal is supplied to the ith control line. The reference power source may have a voltage equal to or higher than a voltage of the data signal. The initial power source may have a voltage lower than the voltage of the data signal. The voltage of the initial power source may be lower than a voltage obtained by subtracting a threshold voltage of the first transistor from the voltage of the data signal. The first power source may have a voltage higher than the voltage of the reference power source.

In the pixels and the organic light emitting display using the same according to exemplary embodiments of the present invention, an image with uniform brightness can be more readily displayed, independent of deviations in the threshold voltages of the driving transistors in the pixels.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
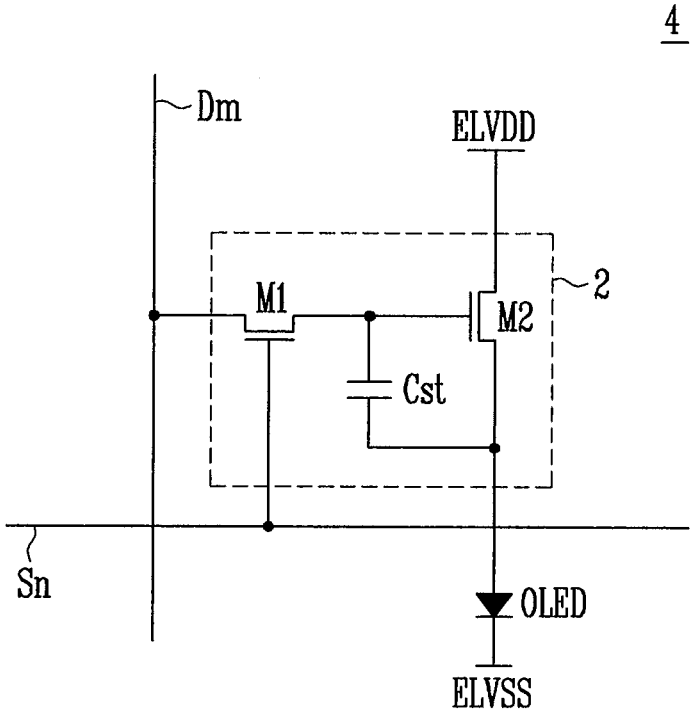
FIG. 1 is a circuit diagram illustrating a pixel of a conventional organic light emitting display.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via one or more additional elements. Further, some of the elements that are not essential to the complete understanding of the invention are omitted for clarity. Also, like reference numerals refer to like elements throughout.

Hereinafter, exemplary embodiments by which those skilled in the art can easily perform the present invention will be described in detail with reference to the accompanying drawings, specifically, FIGS. 2 to 4.

Figure 2:
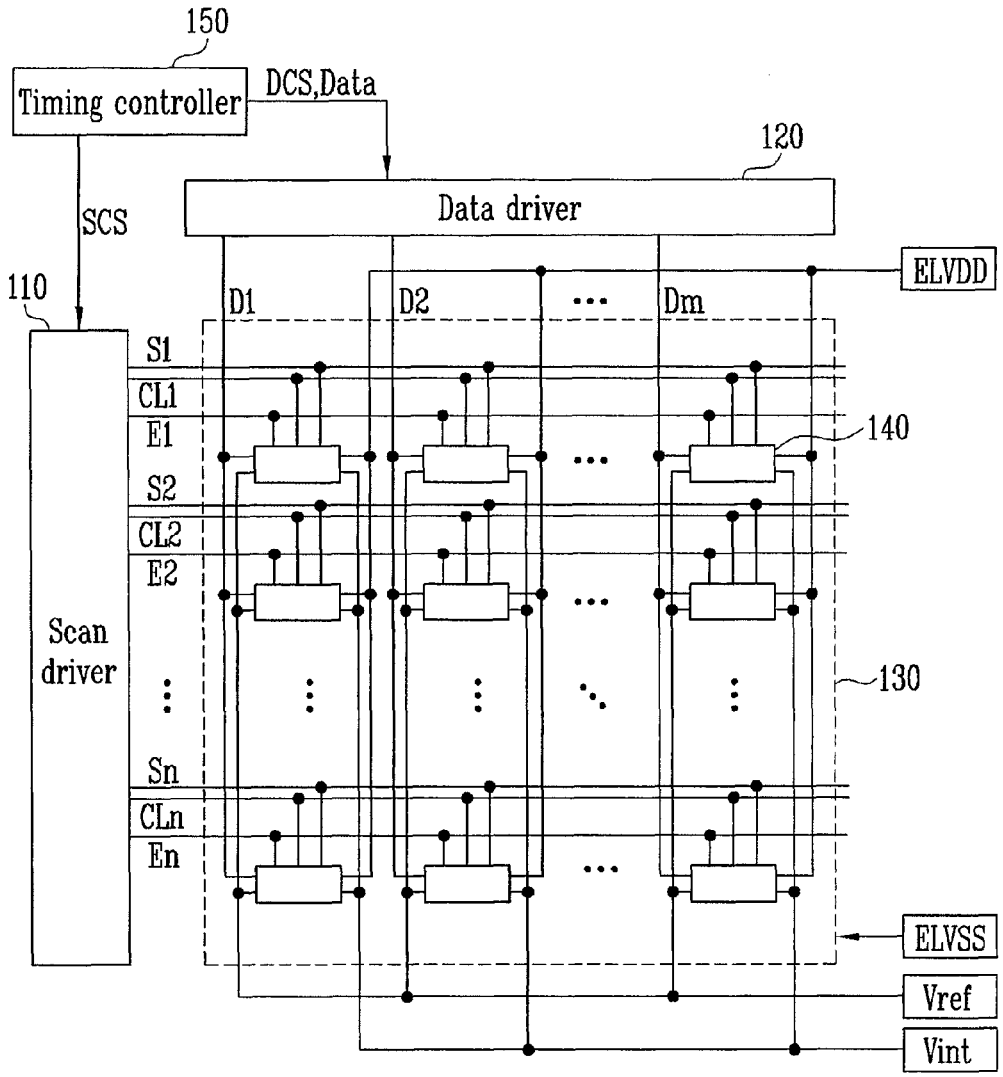
FIG. 2 is a schematic view illustrating an organic light emitting display according to an embodiment of the present invention.

FIG. 2 is a schematic view illustrating an organic light emitting display according to an embodiment of the present invention.

Referring to FIG. 2, an organic light emitting display according to an embodiment of the present invention includes pixels 140 coupled to scan lines S1 to Sn, control lines CL1 to CLn, emission control lines E1 to En, and data lines D1 to Dm, a scan driver 110 for driving the scan lines S1 to Sn, the emission control lines E1 to En, and the control lines CL1 to CLn, a data driver 120 for driving the data lines D1 to Dm, and a timing controller 150 for controlling the scan driver 110 and the data driver 120.

The scan driver 110 receives a scan driving control signal SCS from the timing controller 150. The scan driver 110 generates scan signals and sequentially supplies the generated scan signals to the scan lines S1 to Sn. In addition, the scan driver 110 generates control signals and sequentially supplies the generated control signals to the control lines CL1 to CLn. Here, the control signal supplied to an ith (i is a natural number) control line CL1 is concurrently supplied with the scan signal supplied to the ith scan line Si, and is supplied for a longer duration than the scan signal. For example, the control signal supplied to the ith control line CL1 can be supplied to overlap with the scan signals supplied to at least two scan lines (e.g., Si, Si+1, . . . ).

The scan driver 110 generates the emission control signals and sequentially supplies the generated emission control signals to the emission control lines E1 to En. Here, the emission control signal supplied to the ith emission control line E1 is supplied to overlap with the control signal supplied to the ith control line CL1.

According to the embodiment of the present invention, the scan signals and the control signals are set to have a voltage by which the transistors included in the pixels 140 can be turned on, and the emission control signals are set to have a voltage by which the transistors included in the pixels 140 can be turned off. For example, the scan signals and the control signals can be set to have a high voltage, while the emission control signals can be set to have a low voltage.

The data driver 120 receives a data driving control signal DCS from the timing controller 150. The data driver 120 supplies data signals to the data lines D1 to Dm synchronously with the scan signals.

The timing controller 150 generates the data driving control signal DCS and the scan driving control signal SCS corresponding to synchronization signals supplied from the outside. The data driving control signal DCS is supplied to the data driver 120 and the scan driving control signal SCS is supplied to the scan driver 110. The timing controller 150 supplies the data Data from the outside to the data driver 120.

A display region 130 receives a first power source ELVDD, a second power source ELVSS, a reference power source Vref, and an initial power source Vint from the outside, and supplies the first power source ELVDD, the second power source ELVSS, the reference power source Vref, and the initial power source Vint to the pixels 140. The pixels 140 generate light corresponding to the data signals.

Here, the voltage Vdata corresponding to the data signals, the voltage of the first power source ELVDD, the voltage of the reference power source Vref, and the voltage of the initial power source Vint are set corresponding to Equation 1.

$$ELVDD > Vref \geq Vdata > Vint \quad \text{Equation 1}$$

Referring to Equation 1, the reference power source Vref is set to have a voltage equal to or higher than the voltage Vdata of the data signals. The initial power source Vint is set to have a voltage lower than the voltage Vdata of the data signals. More specifically, the initial power source Vint is set to have a voltage lower than a voltage obtained by subtracting the threshold voltage of the driving transistor from the voltage Vdata of the data signals. The first power source ELVDD is set to have a voltage higher than the voltage of the reference power source Vref.

Figure 3:
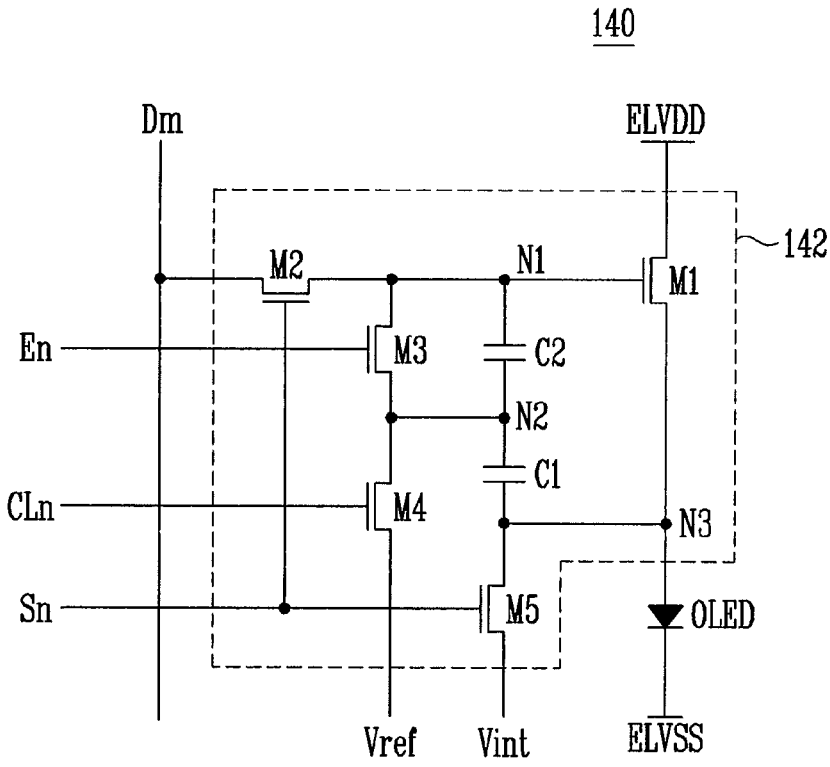
FIG. 3 is a circuit diagram illustrating an embodiment of a pixel of FIG. 2.

FIG. 3 is a circuit diagram illustrating a pixel according to an embodiment of the present invention. For convenience, in FIG. 3, a pixel coupled to an nth scan line Sn and an mth data line Dm is illustrated.

Referring to FIG. 3, the pixel 140 according to the embodiment of the present invention includes an OLED, and a pixel circuit 142 coupled to a data line Dm, a scan line Sn, an emission control line En, and a control line CLn, to control the OLED.

The anode electrode of the OLED is coupled to the pixel circuit 142 and the cathode electrode of the OLED is coupled to a second power source ELVSS. The OLED generates light with a brightness (e.g., a predetermined brightness) corresponding to a current supplied from the pixel circuit 142.

The pixel circuit 142 charges the voltage corresponding to a data signal during a period where a scan signal (e.g., a high scan signal) is supplied to the scan line Sn. Then, the pixel circuit 142 charges the voltage corresponding to the threshold voltage of a first transistor M1 during a period where the supply of the scan signal to the scan line Sn is stopped, and the supply of a control signal to the control line CLn is continued or maintained. Then, the pixel circuit 142 supplies the current corresponding to the charged voltages to the OLED. The pixel circuit 142 includes first to fifth transistors M1 to M5, a first capacitor C1, and a second capacitor C2.

A gate electrode of the first transistor M1 (a driving transistor) is coupled to a first node N1, and a first electrode of the first transistor M1 is coupled to the first power source ELVDD. A second electrode of the first transistor M1 is coupled to the anode electrode of the OLED at a third node N3. The first transistor M1 controls an amount of current supplied to the OLED in response to a voltage applied to the first node N1.

A gate electrode of the second transistor M2 is coupled to the scan line Sn, and a first electrode of the second transistor M2 is coupled to the data line Dm. A second electrode of the second transistor M2 is coupled to the first node N1. The second transistor M2 is turned on when a scan signal (e.g., a high scan signal) is supplied to the scan line Sn to electrically couple the data line Dm to the first node N1.

A gate electrode of the third transistor M3 is coupled to the emission control line En, and a second electrode of the third transistor M3 is coupled to the first node N1 (i.e., the gate electrode of the first transistor M1). A first electrode of the third transistor M3 is coupled to a second node N2. The third transistor M3 is turned off when an emission control signal (e.g., a low emission control signal) is supplied to the emission control line En, and is turned on when the emission control signal is not supplied, to electrically couple the first node N1 and the second node N2.

A gate electrode of the fourth transistor M4 is coupled to the control line CLn, and a second electrode of the fourth transistor M4 is coupled to the second node N2. A first electrode of the fourth transistor M4 is coupled to the reference power source Vref. The fourth transistor M4 is turned on when a control signal (e.g., a high control signal) is supplied to the control line CLn, to supply the voltage of the reference power source Vref to the second node N2.

A gate electrode of the fifth transistor M5 is coupled to the scan line Sn and a first electrode of the fifth transistor M5 is coupled to the third node N3. A second electrode of the fifth transistor M5 is coupled to the initial power source Vint. The fifth transistor M5 is turned on when the scan signal is supplied to the scan line Sn, to supply the initial power source Vint to the third node N3.

The first capacitor C1 and the second capacitor C2 are coupled in series between the third node N3 and the first node N1. The common node between the first capacitor C1 and the second capacitor C2 is coupled to the second node N2, which is also the common node between the third transistor M3 and the fourth transistor M4. Here, the second capacitor C2 and the third transistor M3 are coupled between the first node N1 and the second node N2 in parallel.

Figure 4:
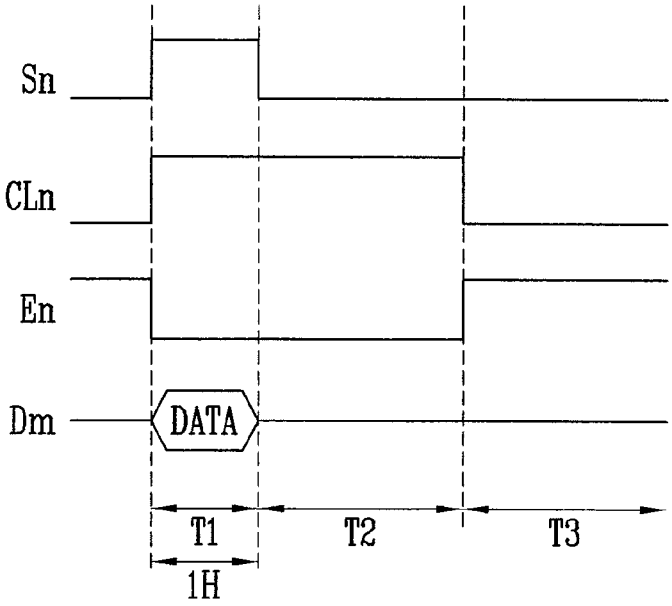
FIG. 4 illustrates waveforms describing a method of driving the pixel of FIG. 3.

FIG. 4 illustrates waveforms for driving the pixel of FIG. 3.

Processes for operating a pixel according to an embodiment of the present invention will be described in detail with reference to FIGS. 3 and 4.

First, a high scan signal, a high control signal, and a low emission control signal are respectively supplied to the scan line Sn, the control line CLn, and the emission control line En in a first period T1.

When the scan signal is supplied to the scan line Sn, the second transistor M2 and the fifth transistor M5 are turned on. When the control signal is supplied to the control line CLn, the fourth transistor M4 is turned on. When the emission control signal is supplied to the emission control line En, the third transistor M3 is turned off.

When the second transistor M2 is turned on, the data signal from the data line Dm is supplied to the first node N1. When the fifth transistor M5 is turned on, the initial power source Vint is supplied to the third node N3. Here, the initial power source Vint is set to have a voltage for the OLED to be turned off. Therefore, light is not generated by the OLED during this time. When the fourth transistor M4 is turned on, the reference power source Vref is supplied to the second node N2.

That is, in the first period T1, the first node N1 is at the voltage Vdata of the data signal, the second node N2 is at the voltage of the reference power source Vref, and the third node N3 is at the voltage of the initial power source Vint. In this case, the second capacitor C2 is charged with a voltage corresponding to a difference between the voltage Vdata of the data signal and the reference power source Vref, and the first capacitor C1 is charged with a voltage corresponding to a difference between the reference power source Vref and the initial power source Vint. In addition, since the current path flowing through the first transistor M1 in the first period T1 flows to the initial power source Vint, the OLED does not emit light.

Then, in a second period T2, the supply of the scan signal to the scan line Sn is stopped (i.e., the scan signal becomes low). When the supply of the scan signal to the scan line Sn is stopped, the second transistor M2 and the fifth transistor M5 are turned off.

When the second transistor M2 is turned off, the first node N1 maintains the voltage supplied during the first period T1 due to the voltage charged in the second capacitor C2. When the fifth transistor M5 is turned off, the voltage of the third node N3 increases to the voltage obtained by subtracting the threshold voltage of the first transistor M1 from the voltage Vdata of the data signal.

To be more specific, in the first period T1, the voltage of the first node N1 is set at the voltage Vdata of the data signal and the voltage of the third node N3 is set at the voltage of the initial power source Vint. Here, the voltage of the initial power source Vint is set at a voltage lower than the voltage obtained by subtracting the threshold voltage of the first transistor M1 from the voltage Vdata of the data signal. Therefore, when the fifth transistor M5 is turned off, the voltage of the third node N3 increases to a voltage obtained by subtracting the threshold voltage of the first transistor M1 from the voltage Vdata of the data signal.

In this case, the voltage of Vref−Vdata is charged in the second capacitor C2 and the voltage of Vref−Vdata+Vth (M1) is charged in the first capacitor C1.

Then, in a third period T3, the supply of the control signal to the control line CLn is stopped (i.e., the control signal becomes low), and the supply of the emission control signal to the emission control line En is stopped (i.e., the emission control signal becomes high). When the supply of the control signal to the control line CLn is stopped, the fourth transistor M4 is turned off. When the supply of the emission control signal to the emission control line En is stopped, the third transistor M3 is turned on.

When the third transistor M3 is turned on, the first node N1 and the second node N2 are electrically coupled to each other. In this case, a voltage difference between the ends of the second capacitor C2 becomes 0, and the voltage charged in the first capacitor C1 becomes the voltage Vgs (M1) between the gate electrode and the source electrode of the first transistor M1. That is, the voltage between the gate electrode and the source electrode of the first transistor M1 is set corresponding to Equation 2.

$$Vgs(M1)=V\text{ref}-V\text{data}+Vth(M1) \quad \text{Equation 2}$$

The amount of current that flows to the OLED corresponding to the voltage of Vgs of the first transistor M1 is therefore set corresponding to Equation 3.

$$loled=\beta(Vgs(M1)-Vth(M1))^2=\beta\{(V\text{ref}-V\text{data}+Vth(M1))-Vth(M1)\}^2=\beta(V\text{ref}-V\text{data})^2 \quad \text{Equation 3}$$

Referring to Equation 3, the current that flows to the OLED is determined by a voltage difference between the voltage of the reference power source Vref and the voltage Vdata of the data signal. Here, since the reference power source Vref has a fixed voltage, the current that flows to the OLED is determined by the voltage Vdata of the data signal. Therefore, according to an embodiment of the present invention, corresponding to Equation 3, an image with uniform brightness can be displayed independent of deviations in the threshold voltages of the first transistors M1 in different pixels of a display.

Furthermore, in FIG. 3, the transistors are NMOS transistors. However, the present invention is not limited to the above described embodiment. For example, the transistors can be PMOS transistors. In this case, the polarities of the supplied waveforms illustrated in FIG. 4 would be inverted. However, the processes for operating the pixel would be substantially similar.

While the present invention has been described in connection with certain exemplary embodiments, it is to be understood that the invention is not limited to the disclosed embodiments, but is instead intended to cover various modifications and equivalent arrangements included within the spirit and scope of the appended claims, and equivalents thereof.

What is claimed is:

1. A pixel, comprising:

an organic light emitting diode (OLED) having a cathode electrode coupled to a second power source;

a first transistor for controlling an amount of current that flows from a first power source to the second power source via the OLED corresponding to a data signal;

a second transistor coupled between a data line and a gate electrode of the first transistor and turned on when a scan signal is supplied to a scan line;

a third transistor coupled between the gate electrode of the first transistor and a reference power source and turned off when an emission control signal is supplied to an emission control line;

a fourth transistor coupled between the third transistor and the reference power source and turned on when a control signal is supplied to a control line;

a fifth transistor coupled between an anode electrode of the OLED and an initial power source different from the and turned on when the scan signal is supplied to the scan line;

a first capacitor coupled between the anode electrode of the OLED and a node between the third transistor and the fourth transistor; and a second capacitor coupled between the node and the gate electrode of the first transistor.

2. The pixel as claimed in claim 1, wherein the second transistor and the fifth transistor are on for a portion of a period in which the fourth transistor is on.

3. The pixel as claimed in claim 2, wherein the second transistor and the fifth transistor are configured to be turned on when the fourth transistor is turned on.

4. The pixel as claimed in claim 2, wherein the third transistor is off when the fourth transistor is on.

5. The pixel as claimed in claim 1, wherein the reference power source has a voltage equal to or higher than a voltage of the data signal.

6. The pixel as claimed in claim 5, wherein the initial power source has a voltage lower than the voltage of the data signal.

7. The pixel as claimed in claim 6, wherein the voltage of the initial power source is lower than a voltage obtained by subtracting a threshold voltage of the first transistor from the voltage of the data signal.

8. The pixel as claimed in claim 5, wherein the first power source has a voltage higher than the voltage of the reference power source.

9. An organic light emitting display, comprising:

a scan driver for sequentially supplying a scan signal to scan lines, sequentially supplying an emission control signal to emission control lines, and sequentially supplying a control signal to control lines;

a data driver for supplying a data signal to data lines corresponding to the scan signal; and pixels at crossing regions of the scan lines and the data lines, wherein a pixel positioned on an ith (i is a natural number) horizontal line from among the pixels comprises:

an organic light emitting diode (OLED) having a cathode electrode coupled to a second power source;

a first transistor for controlling an amount of current that flows from a first power source to the second power source via the OLED corresponding to the data signal;

a second transistor coupled between the data line and a gate electrode of the first transistor and turned on when the scan signal is supplied to an ith scan line of the scan lines;

a third transistor coupled between the gate electrode of the first transistor and a reference power source and turned off when the emission control signal is supplied to an ith emission control line of the emission control lines;

a fourth transistor coupled between the third transistor and the reference power source and turned on when the control signal is supplied to an ith control line of the control lines;

a fifth transistor coupled between an anode electrode of the OLED and an initial power source different from the first power source and turned on when the scan signal is supplied to the ith scan line;

a first capacitor coupled between the anode electrode of the OLED and a node between the third transistor and the fourth transistor; and a second capacitor coupled between the node and the gate electrode of the first transistor.

10. The organic light emitting display as claimed in claim 9, wherein the scan driver is configured to supply the scan signal to the ith scan line when the control signal is supplied to the ith control line.

11. The organic light emitting display as claimed in claim 10, wherein the control signal has a longer duration than the scan signal.

12. The organic light emitting display as claimed in claim 10, wherein the scan driver is configured to supply the emission control signal to the ith emission control line when the control signal is supplied to the ith control line.

13. The organic light emitting display as claimed in claim 9, wherein the reference power source has a voltage equal to or higher than a voltage of the data signal.

14. The organic light emitting display as claimed in claim 13, wherein the initial power source has a voltage lower than the voltage of the data signal.

15. The organic light emitting display as claimed in claim 14, wherein the voltage of the initial power source is lower than a voltage obtained by subtracting a threshold voltage of the first transistor from the voltage of the data signal.

16. The organic light emitting display as claimed in claim 13, wherein the first power source has a voltage higher than the voltage of the reference power source.

* * * * *